US006276267B1

(12) United States Patent
Yoneoka

(10) Patent No.: US 6,276,267 B1
(45) Date of Patent: Aug. 21, 2001

(54) PRINTING SYSTEM

(75) Inventor: Hideharu Yoneoka, Amimachi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/493,179

(22) Filed: Jan. 28, 2000

(30) Foreign Application Priority Data

Jan. 29, 1999 (JP) ..... 11-021704

(51) Int. Cl.[7] ..... B41F 15/00

(52) U.S. Cl. ..... 101/114; 101/118; 101/128.4; 399/410; 270/58.02

(58) Field of Search ..... 101/114, 129, 101/127, 128.4, 116, 117, 118; 399/410, 85, 361, 403; 271/9.08, 126, 296; 270/58.02, 58.08; 358/206

(56) References Cited

U.S. PATENT DOCUMENTS 5,404,805 * 4/1995 Fujimoto et al. ..... 101/118
5,598,258 * 1/1997 Sato et al. ..... 399/85
5,690,324 * 11/1997 Otomo et al. ..... 270/58.02
5,794,928 * 8/1998 Araseki et al. ..... 271/9.08
5,835,839 * 11/1998 Kaneda ..... 399/361
5,845,570 * 12/1998 Isozaki et al. ..... 101/116
5,882,005 * 3/1999 Araseki et al. ..... 271/126
5,890,050 * 3/1999 Kaneda ..... 399/403
5,924,689 * 7/1999 Fukai et al. ..... 270/58.08
5,931,463 * 8/1999 Kaneda ..... 271/296
5,982,502 * 11/1999 Jinnai ..... 358/296
6,010,129 * 1/2000 Moltizuki et al. ..... 270/58.18
6,161,476 * 12/2000 Yoneoka ..... 101/118

* cited by examiner

*Primary Examiner*—Eugene Eickholt
(74) *Attorney, Agent, or Firm*—Nixon & Peabody LLP; Donad R. Studebaker

(57) ABSTRACT

A printing system comprises a printer for conducting stencil making and printing, a finisher such as a sorter for receiving and holding printed sheets discharged from the printer and aligning the received printed sheets, and control means for starting stencil making in the printer without waiting for the finisher to finish aligning the printed sheets. The control means is preferably responsive to completion of printed sheet insertion in the finisher for substantially simultaneously starting the stencil making operation in the printer and the aligning operation in the finisher. The printing system enables a reduction in overall printing time.

5 Claims, 17 Drawing Sheets

PRINTING SYSTEM

BACKGROUND OF THE INVENTION

1. Field of the Invention

The present invention relates to printing system, particularly to a printing system including a printer such as a stencil printer for carrying out stencil making and a finisher for receiving and holding printed sheets discharged from the printer.

2. Description of the Related Art

A stencil printer is an image forming apparatus that digitally processes an original image, perforates a stencil paper (stencil) with the image, winds the stencil on a printing drum, and forms an image identical to the original on paper by transferring ink from the interior of the printing drum to the paper through the perforated stencil. Printing of a desired number of sheets therefore requires a stencil making operation.

A finisher is an after-processing apparatus, generally referred to as a "sorter," that receives printed sheets discharged from an image forming apparatus, sorts them into sheet holding means (row of bins) inside the apparatus, and arranges (aligns) and/or a staples the shorted sheets. The finisher therefore incorporates an operation of receiving and storing printed sheets and operations for effecting prescribed processing, e.g., alignment, with respect to the stored printed sheets.

When the conventional printing system consisting of a stencil printer and a finisher is used to print multiple originals, sort the printed sheets by page and staple the sorted sheets, first a stencil making operation is conducted, then printing is started together with sorting of the printed sheets, whereafter the sorted sheets are aligned, and, upon completion of the alignment, stencil making is started with respect to the next original. After these operations have been repeated a number of times equal to the number of originals, stapling is carried out.

The time required to complete the whole job is therefore considerable because it is the sum of the time required for conducting stencil making for the total number of originals, the time required for printing and sorting, the time required for alignment, and the time required for the final stapling operation.

In the case of a sorter equipped with moving bins, moreover, an operation is required in addition to the alignment and stapling operations for temporarily returning the row of bins to a standby location after storing the sheets printed with one stencil and before storing the sheets printed with the next stencil.

SUMMARY OF THE INVENTION

In light of the foregoing circumstances, the present invention has as one of its objects to shorten the total printing time of the printing system and, for this, focuses on the fact that the print making is an operation conducted only on the printer side while the alignment and bin moving operations are operations conducted on only on the finisher side.

The printing system according to the present invention comprises a printer for conducting stencil making and printing, a finisher for receiving and holding printed sheets discharged from the printer and effecting at least one prescribed processing operation on the received printed sheets, and control means for starting stencil making in the printer without waiting for completion of said at least one prescribed processing operation in the finisher.

The control means is preferably responsive to completion of the insertion of the printed sheets in the finisher for substantially simultaneously starting the stencil making operation in the printer and the at least one prescribed processing operation in the finisher. Instead, however, it can be responsive to completion of the receiving and holding of the printed sheets in the finisher for starting the stencil making operation in the printer after a delay.

When the finisher is a sorter comprising a row of stationary bins for holding the printed sheets, sheet sorting means for inserting the printed sheets into the bins and alignment means for aligning the printed sheets held in the bins, the at least one prescribed processing operation is an alignment operation conducted by the alignment means.

When the finisher is a sorter comprising a row of stationary bins for holding the printed sheets, sheet sorting means for inserting the printed sheets into the bins, alignment means for aligning the printed sheets held in the bins and stapling means for stapling sheaves of printed sheets held in the bins, the at least one prescribed processing operation is an alignment operation conducted by the alignment means and a stapling operation conducted by the stapling means.

When the finisher is a sorter comprising a row of moving bins for holding the printed sheets, the at least one prescribed processing operation is an operation of moving the row of bins to a standby location.

The present invention starts the stencil making operation of the printer without waiting for completion of the prescribed processing operation or operations in the finisher and therefore shortens the overall printing time in printing using multiple originals.

Particularly in the aspect of the present invention in which the stencil making operation in the printer and the prescribed operation or operations in the finisher are conducted substantially simultaneously, the overall printing time is shorten by the amount of time for alignment or bin moving because the control means responds to completion of the operation for receiving and holding the printed sheets by immediately starting the next stencil making operation.

DESCRIPTION OF THE PREFERRED EMBODIMENT

The present invention will now be described in further detail with reference to the accompanying drawings.

Figure 1:
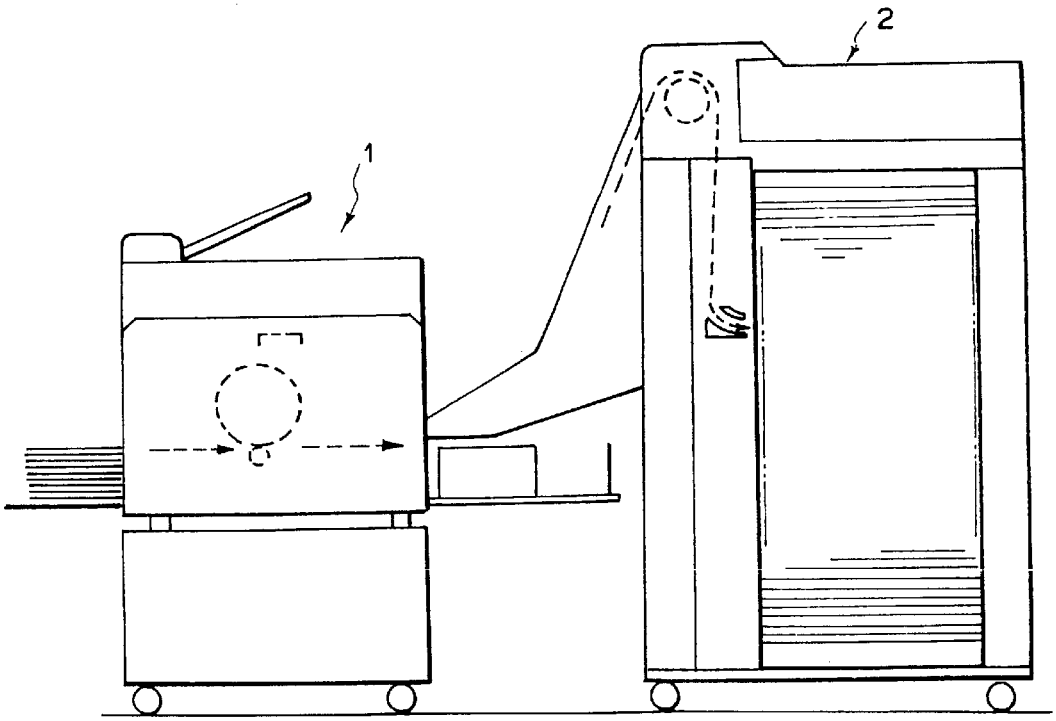
FIG. 1 is a diagram showing the overall configuration of a printing system that is an embodiment of the present invention.

FIG. 1 is a diagram showing the configuration of a printing system that is an embodiment of the present invention. As shown in FIG. 1, the printing system according of this embodiment consists of printer, namely, a stencil printer with stencil maker 1, and a finisher, namely, a sorter 2.

Stencil Printer

Figure 2:
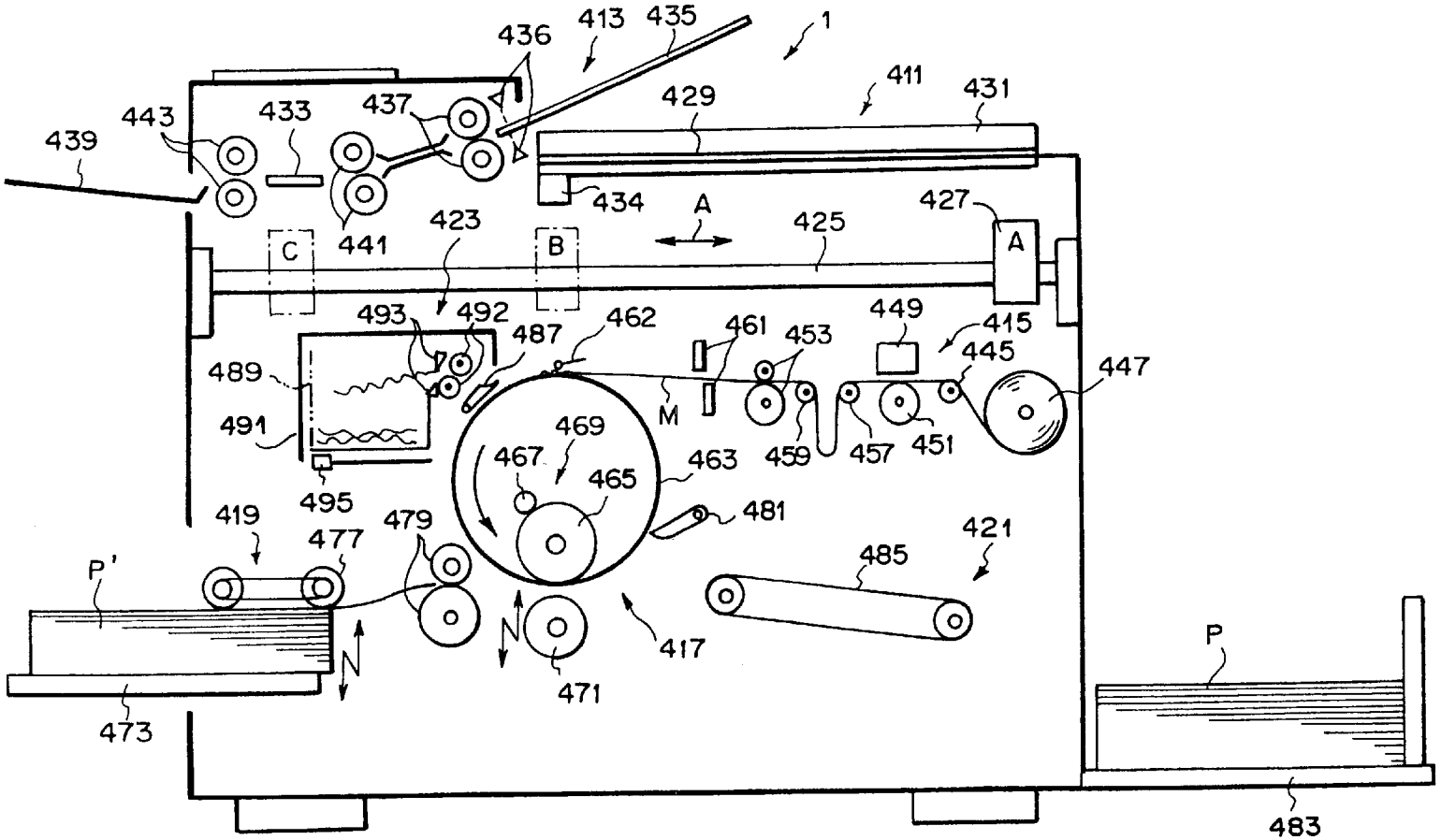
FIG. 2 is a diagram showing the structure of the stencil printer of FIG. 1.

FIG. 2 is a diagram showing the structure of the stencil printer with stencil maker 1. The stencil printer 1 is equipped with an original document reading section 411, an automatic document feeder (hereinafter referred to as ADF or ADF unit) 413, a stencil making section 415, a printing section 417, a sheet feeding section 419, a sheet discharge section 421, and a stencil discard section 423.

The document reading section 411 has a line image sensor 427 supported on guide rails 425 (only one shown) to move in the direction of arrow A in FIG. 2, a document glass 429 for placing an original such as a book, a pressure plate 431 provided on the document glass 429 to be openable/closable, a target glass plate 433 to which an original sheet is fed by the ADF 413, and an original sensor 434 provided on the pressure plate side for detecting the presence of an original document on the document glass 429. When a book type original is read, an unshown drive device is operated to drive the line image sensor 427 along the guide rails 425 under the document glass 429 to effect scanning at a prescribed speed between a home position designated by the symbol A and a scan end position designated by the symbol B. When an original sheet is read using the ADF 413, the line image sensor 427 is moved to and made stationary at a position directly under the target glass plate 433 as indicated by the symbol C.

The ADF 413 has an original input tray 435 for holding a stack of original sheets, original pickup rollers 437 for feeding the original sheets on the original input tray 435 toward the top of the target glass plate 433 one by one, an original output tray 439 for receiving original sheets after reading, original feed rollers 441 located upstream of the target glass plate 433 relative to the direction of original sheet conveyance for feeding originals from the original input tray 435 across the top of the target glass plate 433 at a prescribed scanning speed, original feed rollers 443 located downstream of the target glass plate 433 for discharging original sheets from the target glass plate 433 to the original output tray 439, and an ADF original sensor 436 for optically detecting the presence of original sheets on the original input tray 435.

The original sheets placed on the original input tray 435 of the ADF 413 are picked up individually by the original pickup rollers 437 and conveyed to the upper surface of the target glass plate 433 by the original feed rollers 441. As an original sheet passes over the target glass plate 433, it is subjected to image reading by the line image sensor 427 stationed at position C under the target glass plate 433. After being read, the original sheet is discharged to the original output tray 439 by the original feed rollers 443.

The stencil making section 415 has a stock roll section 447 for stocking heat-sensitive stencil paper M in the form of a web, a thermal head 449 composed of multiple dot heating elements arrayed in lines perpendicular to the conveyance direction of the stencil paper M, a platen roller 451 facing the thermal head 449, stencil paper feed rollers 453, stencil paper guide rollers 445, 457 and 459, and a stencil paper cutter 461. Image data representing the original image read by the line image sensor 427 are input to the stencil making section 415 and the individual dot heating elements of the thermal head 449 are selectively heated in accordance with the input image data to produce a stencil by thermally perforating the heat-sensitive stencil paper M in a dot matrix pattern. The stencil paper M is cut by a cutter 461 after stencil making.

The printing section 417 has a stencil drum 463 of porous ink-permeable structure which is equipped on its outer surface with a stencil clamp section 462 for clamping the leading end of a stencil to be wound thereabout and is driven to rotate about its own center of rotation counterclockwise as seen in FIG. 2, an ink squeezer 469 including a squeegee roller 465 and a doctor rod 467 located inside the stencil drum 463, and a press roller 471 for pressing cut-sheet printing paper onto the ink squeezer 469. A stencil supplied from the stencil making section 415 is wound on the outer surface of the stencil drum 463.

The sheet feeding section 419 has a sheet feeder tray 473 for stacking sheets of printing paper P', sheet feed rollers 477 for feeding out sheets of printing paper P' one at a time, and timing rollers 479 for feeding sheets of printing paper P' between the stencil drum 463 and the press roller 471.

Figure 3A:
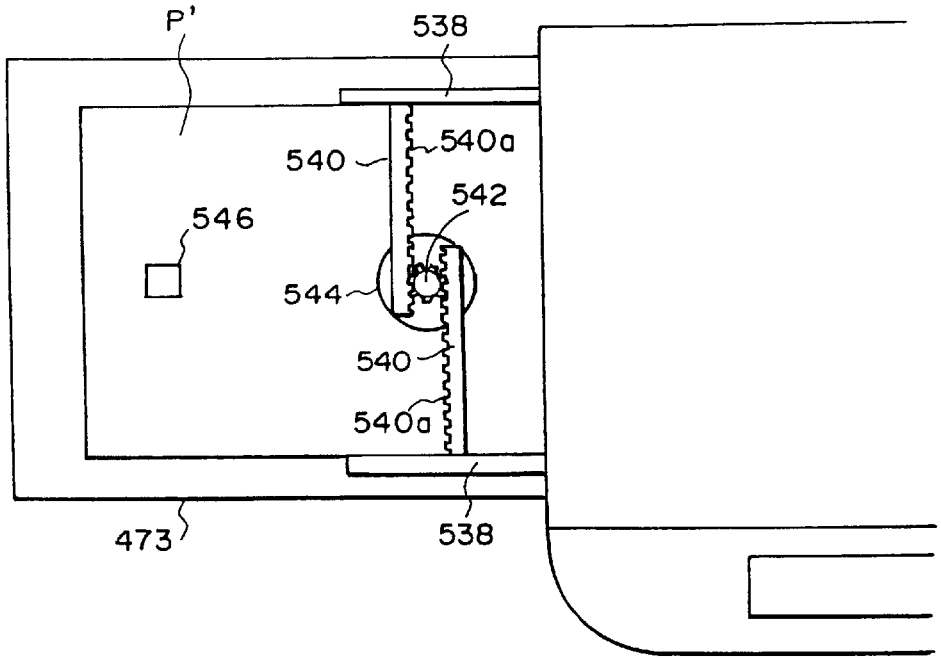
FIG. 3*a* is a plan view of the sheet feeder tray of FIG. 2.
Figure 3B:
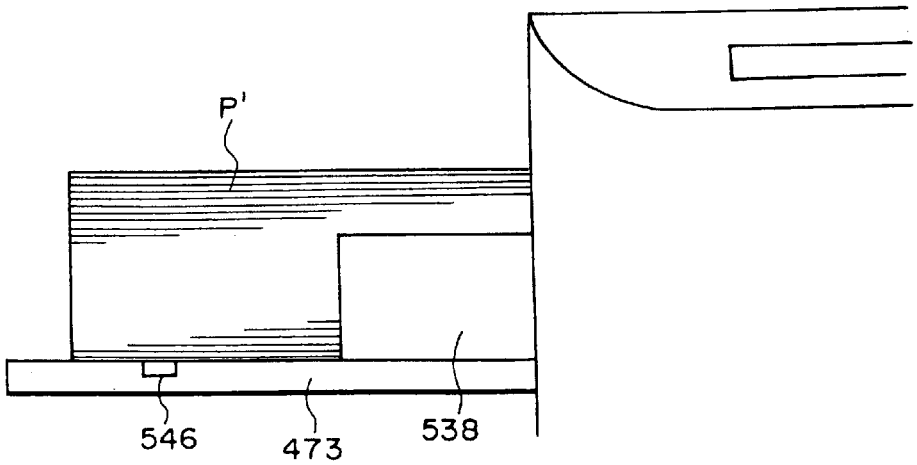
FIG. 3*b* is a side view of the sheet feeder tray of FIG. 2.

FIGS. 3(*a*) and 3(*b*) show plan and side views of the sheet feeder tray 473 structure. As shown, guide plates 538 are provided in facing relationship one on either side of the sheet feeder tray 473 to retain and guide the cut-sheet printing paper P' by maintaining contact with the opposite side edges thereof. A rack 540 is attached to each guide plate 538. The racks 540 are provided inside the sheet feeder tray 473 to project along the surface of the sheet feeder tray 473 perpendicularly to the direction in which the sheets of printing paper P' are fed. The racks 540 are fixed with their toothed sides 540*a* facing each other across a prescribed interval in the direction of the printing paper P' feed.

The toothed side 540*a* of each rack 540 engages with a pinion 542 provided at the middle portion of the sheet feeder tray 473 near its feed-out end. A potentiometer 544 linked with the shaft of the pinion 542 under the sheet feeder tray 473 produces an output voltage that varies with the rotational position of the pinion 542. When the spacing between the guide plates 538 is changed to match the size of the printing paper P', the racks 540 move simultaneously in opposite directions and rotate the pinion 542, whereby the output of the potentiometer 544 on the shaft of the pinion 542 changes. The width of the printing paper P' in the scanning direction is determined from the magnitude of the output.

A paper sensor 546 for detecting presence/absence of printing paper P' in the sheet feeder tray 473 is provided at the rear center of the sheet feeder tray 473. The paper sensor 546 detects whether or not the length of the printing paper P' in the sub-scanning direction is greater than a prescribed value. The potentiometer 544 and the paper sensor 546 are members of a paper size detector that discriminates the size of the printing paper P' and provides paper size information, such as whether the paper is of standard or nonstandard size. In the present embodiment, the main scanning direction lies perpendicular to the conveyance direction of the printing paper P' and the sub-scanning direction lies in the conveyance direction of the printing paper P'.

The sheet discharge section 421 has a stripping claw 481 for stripping printed sheets P off the stencil drum 463, a non-sort output tray 483 for stacking the printed sheets P, and a belt-type discharge conveyor 485 for conveying printed sheets P stripped off the stencil drum 463 by the stripping claw 481 to the non-sort output tray 483.

The stencil discard section 423 has a stencil detacher claw 487 for peeling stencil papers (stencils) M wound on the outer surface of the stencil drum 463 off the stencil drum 463, a box support 491 for detachably supporting a discarded stencil box 489 for depositing discarded stencils M, and rollers 492 for delivering the discarded stencils M peeled off the stencil drum 463 by the stencil detacher claw 487 into the discarded stencil box 489. A discarded stencil sensor 493 of photoelectric type is provided at the entrance to the discarded stencil box 489 to detect delivery of the discarded stencils M into the discarded stencil box 489. The stencil discard section 423 is further equipped with a box-actuated switch 495 for detecting whether the discarded stencil box 489 is attached to the box support 491.

When stencil printing is conducted with this stencil printer 1, the stencil drum 463 is driven by an unshown drive unit to rotate about its own center of rotation counterclockwise as seen in FIG. 2 and the timing rollers 479 operate at the proper timing relative to the rotation of the stencil drum 463 to feed a sheet of the printing paper P' from the sheet feeder tray 473 to between the stencil drum 463 and the press roller 471. The press roller 471 presses the printing paper P' onto the stencil M on the outer surface of the stencil drum 463 to effect press-wise stencil printing.

The printed sheet P is stripped from the stencil drum 463 by the stripping claw 481, conveyed to the non-sort output tray 483 by the discharge conveyor 485, and stacked on the non-sort output tray 483 with its image-printed side facing up. When the stencil M has served its purpose, it is detached from the stencil drum 463 by the stencil detacher claw 487 and delivered to the discarded stencil box 489 by the rollers 492.

Sorter

The sorter 2 serving as a finisher in this embodiment will now be explained.

Figure 4:
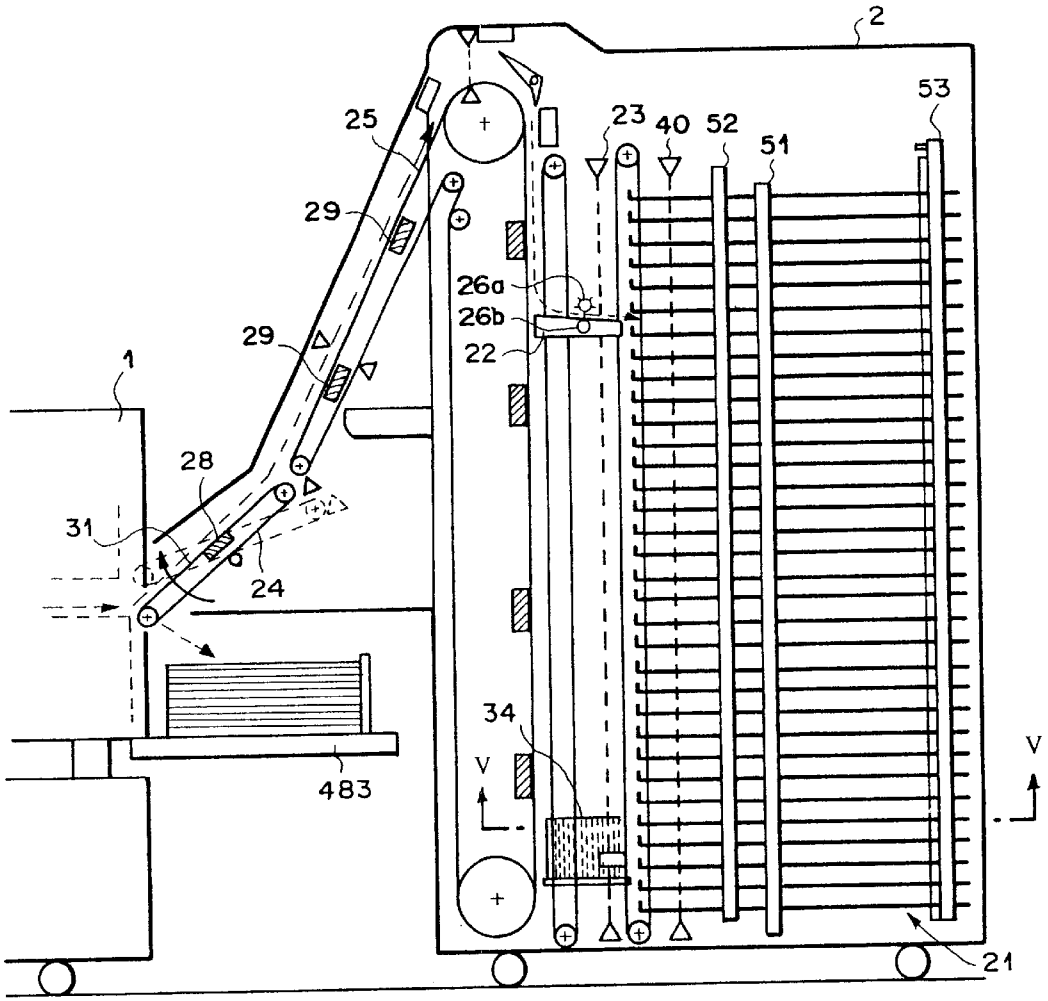
FIG. 4 is diagram showing the structure of the sorter of FIG. 1.

FIG. 4 shows the structure of the sorter 2 of this embodiment of the present invention. As shown, the sorter 2 is equipped with a vertical row of bins 21 for holding printed sheets P, an indexer (sheet sorting means) 22 for inserting printed sheets P into the bins 21, an indexer sensor 23 for detecting whether the printed sheets P are reliably inserted into the bins 21, a sheet sensor 40 for detecting whether printed sheets P are present in any of the bins and conveyor belts 24 and 25 for conveying printed sheets P discharged from the stencil printer 1 to the bins 21.

The indexer 22 is driven vertically by an unshown DC servo motor. As it moves, it sequentially inserts printed sheets P into the bins 21 in proper order while the indexer sensor 23 checks that each insertion is properly executed. The indexer 22 is equipped with a pair of rollers 26*a* and 26*b* that pinch the printed sheet P from opposite sides. When the upper roller 26*a* moves down into pressure contact with the lower roller 26*b*, the rollers 26*a*, 26*b* pinch the printed sheet P conveyed therebetween and impart it with force to convey it into a bin. Even a printed sheet P or the like that is limp and hard to convey can therefore be reliably conveyed without failure owing to the fact that it is caught between the two rollers. Soiling of the printed surface of the printed sheet P conveyed as pinched between the rollers 26*a*, 26*b* can be minimized by forming the surface of the upper roller 26*a* that contacts the printed surface with sharp, needle-like protrusions. Soiling of the printed surface can further be prevented by separating the upper roller 26*a* from the lower roller 26*b* to release the printed sheet P from the pinched state.

The conveyor belts 24, 25 are driven by unshown DC motors. Suction fans 28 and 29 are provided near the conveyor belts 24, 25 to supply negative pressure for sucking the printed sheets P onto the conveyor belts 24, 25. The suction produced by the suction fans 28, 29 enables the printed sheets P discharged from the stencil printer 1 to be conveyed to the bins 21 under suction attachment. The conveyor belt 24 and the suction fan 28 constitute a conveyance path 31 for mode switching. The conveyance path 31 can be selectively driven by an unshown drive mechanism to either of the positions indicated by the solid and broken lines in FIG. 4. When the mode-switching conveyance path 31 is raised (broken line in FIG. 4), the printed sheets P discharged from the stencil printer 1 pass under the conveyance path 31 into the non-sort output tray 483. When the conveyance path 31 is lowered (solid line), the printed sheets P discharged from the stencil printer 1 are sucked onto the conveyor belt 24 and conveyed to the sorter 2. The mode-switching conveyance path 31 is initially in the raised position. It is left in this position during operation in the non-sort mode, which does not use the sorting bins of the sorter 2. When the selected mode is one that utilizes the sorting bins of the sorter 2, i.e., when it is the sort mode, group mode or dry mode, the conveyance path 31 is controlled to swing to the lowered position at the start and to return to the initial state upon completion of the sorting job.

The sorter 2 is equipped with alignment rods 51, 52 and 53 driven by unshown pulse motors for aligning the printed sheets P inserted into the bins 21, and with a stapler 34 driven vertically in FIG. 4 by an unshown pulse motor for stapling the printed sheets P inserted into each bin 21, one bin at a time starting from the topmost.

Alignment Rods, Stapler

Figure 5:
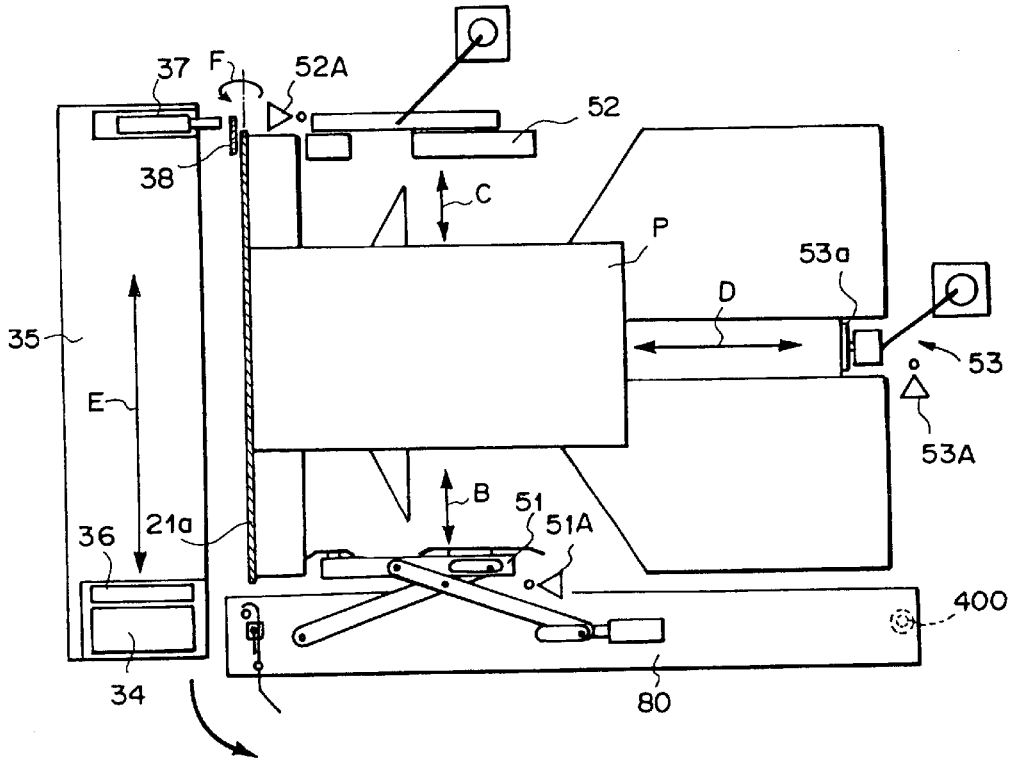
FIG. 5 is sectional view taken along line I—I in FIG. 4.

FIG. 5 is sectional view taken along line I—I in FIG. 4 showing structure of the bins 21, alignment rods 51, 52, 53 and stapler 34 of the sorter 2 in detail.

The alignment rods 51 and 52 move perpendicularly to the conveyance direction of the printed sheets P, as indicated by the arrows B and C, respectively. The alignment rod 51 operates first to center the printed sheets P in the bins and the alignment rod 52 thereafter moves perpendicularly to the conveyance direction of the printed sheets P to sandwich the printed sheets P between itself and the alignment rod 51, thereby aligning the printed sheets P. The alignment rod 53 moves in parallel with the conveyance direction of the printed sheets P, as indicated by arrow D, and operates to align the printed sheets P by pushing them against an upright gate 21*a* at the end of each bin. The upright gates 21*a* are biased by springs or other energizing means to rotate in the direction opposite from that indicated by the arrow F in FIG. 5. The range of their rotation is limited by an unshown member so as to stop them at the position where they contact the ends of the printed sheets P on the upstream side relative to the conveyance direction of the printed sheets P. An upright gate tilt lever 38 is fastened on each upright gate 21*a*. When a stapler unit 35 moves downward with a solenoid 37 (explained later) turned ON (with a movable portion thereof projecting toward the lever 38), the movable portion of the solenoid 37 pushes the lever 38 down to rotate the upright gate 21*a* to its horizontal position. Home position (HP) sensors 51A, 52A and 53A are provided for detecting whether the alignment rods 51, 52, 53 are in home position (HP).

The stapler 34 is installed in the stapler unit 35 to be movable in the direction of arrow E together with an in-pusher 36 for pushing the printed sheets P back into the bins as explained later. The solenoid 37 for tilting the upright gates 21*a* at the ends of the bins is mounted on the stapler unit 35.

When the stapler 34 used, stapling is begun after all of the printed sheets P have been aligned. Upon completion of the alignment, the indexer 22 retreats to the top of the conveyor section and the stapler unit 35 moves to a location above the uppermost bin by the height of one bin (hereafter called the "0th bin position"). The solenoid 37 is then turned ON to ride on the lever 38 of the 1st bin, whereafter the stapler unit 35 is lowered to the 1st bin to open its upright gate 21*a*. An out-pusher 53*a* mounted on the alignment rod 53 is then lowered to the bin at which stapling is to be started and the alignment rod 53 is moved toward the printed sheets P so that the printed sheets P in the bin concerned are pushed toward the stapler unit 35 by the pusher 53*a*. The pushed-out printed sheets P are then stapled by the stapler 34. When the stapling is finished, the in-pusher 36 mounted at the side of the stapler 34 pushes the stapled sheets P back into the bin and solenoid 37 turns OFF to allow the upright gate 21*a* to close. The foregoing process is then repeated to effect stapling at every bin where printed sheets P are present.

Operation Panel

Figure 6:
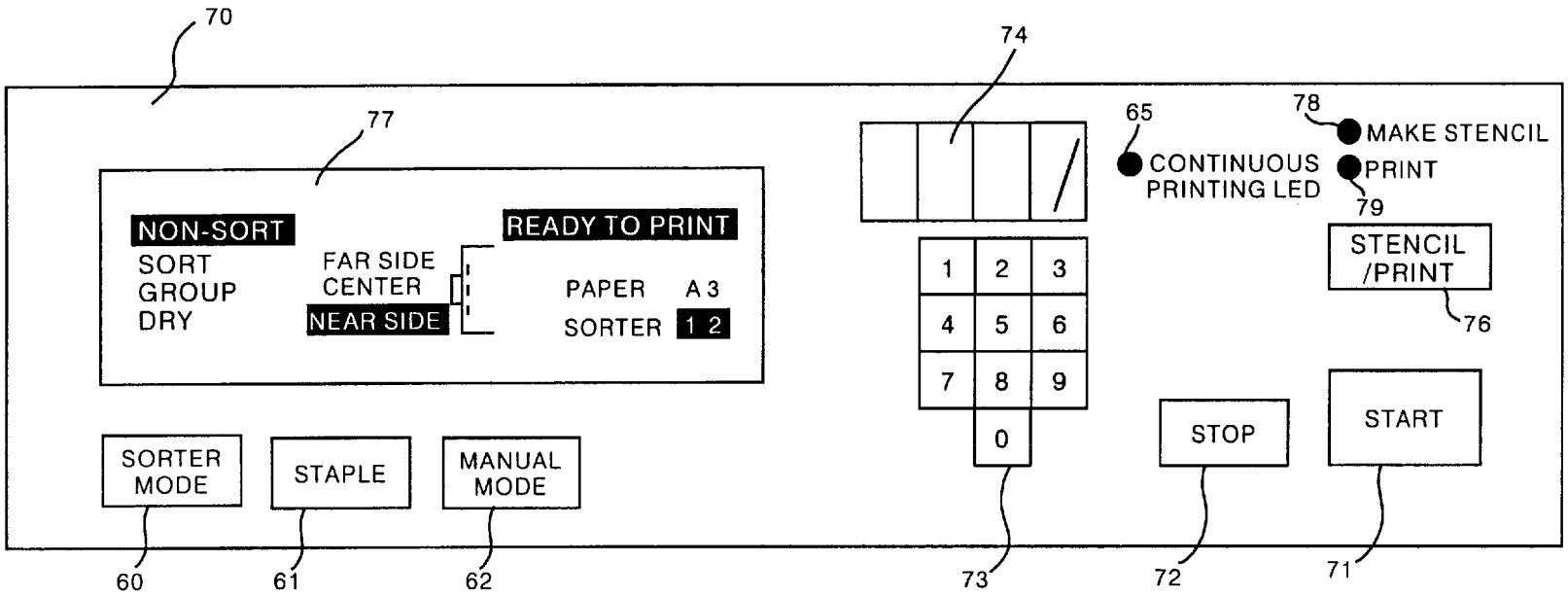
FIG. 6 is a diagram showing the operation panel section of the stencil printer.

FIG. 6 is a diagram showing an operation panel 70 provided in the stencil printer 1. The operation panel 70 comprises a ten-digit keypad 73, a copies LED indicator 74, a display 77 consisting of a liquid crystal panel or the like, a sorter mode button 60, a manual mode button 63, a start button 71, a stop button 72, a stencil/print button 76, a continuous printing button 75, a stencil making mode LED 78, a print mode LED 79, and a continuous printing LED 65.

The keypad 73 is composed of numerical keys 0 to 9 which are pressed to enter settings such as the number of copies to be printed.

The copies LED indicator 74 displays the number of copies to be printed entered using the ten-digit keypad 73. The number displayed by the LED indicator 74 decreases from the set value by one synchronously with the discharge of each printed sheet P during the printing operation of the stencil printer 1.

The display 77 displays error messages when a malfunction such as a paper jam occurs and also displays the size of the printing paper P' loaded in the sheet feeder tray 473. The display 77 further displays selection for use of the sorter 2 connected to the stencil printer 1, the set condition of the auto-stapler, the operating state of the sorter 2, and pertinent error messages when problems arise. Other information displayed by the display 77 includes the operating state of the stencil printer 1, the state of the sorter 2 use mode, the operating state of the stencil printer 1, the selected sorter mode, and the staple mode. The sorter mode and the staple mode displayed in reverse video are the ones currently in effect.

The sorter mode button 60 is pressed to select one mode from among the non-sort mode for depositing the printed sheets P in the non-sort output tray 483 and the three modes for storing the printed sheets P using the sorter 2 (i.e., the sort mode, group mode and dry mode). When the sorter mode button 60 is repeatedly pressed after power-on, the selected mode circulates among the non-sort mode, sort mode, group mode, dry mode and non-sort mode in the order mentioned. In the non-sort mode, the printed sheets P discharged from the paper output port of the stencil printer 1 are fed directly into the non-sort output tray 483.

In the sort mode, the printed sheets P discharged from the paper output port of the stencil printer 1 are successively sorted by page into the bins to be collated into multipage documents, pamphlets, books or the like.

In group mode, the printed sheets P discharged from the paper output port of the stencil printer 1 are sorted into groups and stored in bins to carry out multiple sorting by document of (sheets×groups).

In dry mode, which is for reducing the amount of transfer printing to the backs of the overlaid sheets, the process of sequentially distributing the printed sheets P discharged from the paper output port of the stencil printer 1 into the bins one by one is repeated until the total number of copies has been printed.

The staple button 61 is pressed to conduct auto-stapling. In auto-stapling, as explained further later, the stapler 34 is used to staple the printed sheets P after they have been sorted into the bins and aligned. Repeatedly pressing the staple button 61 after power-on circulates the selected mode among near-single mode, center-double mode, far-single mode, and stapling OFF mode.

The manual mode button 63 is used to enter instructions for stapling and alignment of the printed sheets P in the sorter 2.

The start button 71 is pressed to start the operation of the stencil printer 1 and the sorter 2.

The stop button 72 is pressed to stop the operation of stencil printer 1 and the sorter 2.

The stencil/print button 76 is pressed to switch between stencil making operation and printing operation. The LEDs 78 and 79 are provided above the stencil/print button 76 to indicate which of the stencil making and printing modes is in effect.

The continuous printing button 75 is pressed to execute from stencil making through printing as a continuous operation. The continuous printing LED 65 is provided above the continuous printing button 75 to indicate the continuous printing setting.

Control Circuit

The control circuit of the present embodiment will now be explained.

Figure 7:
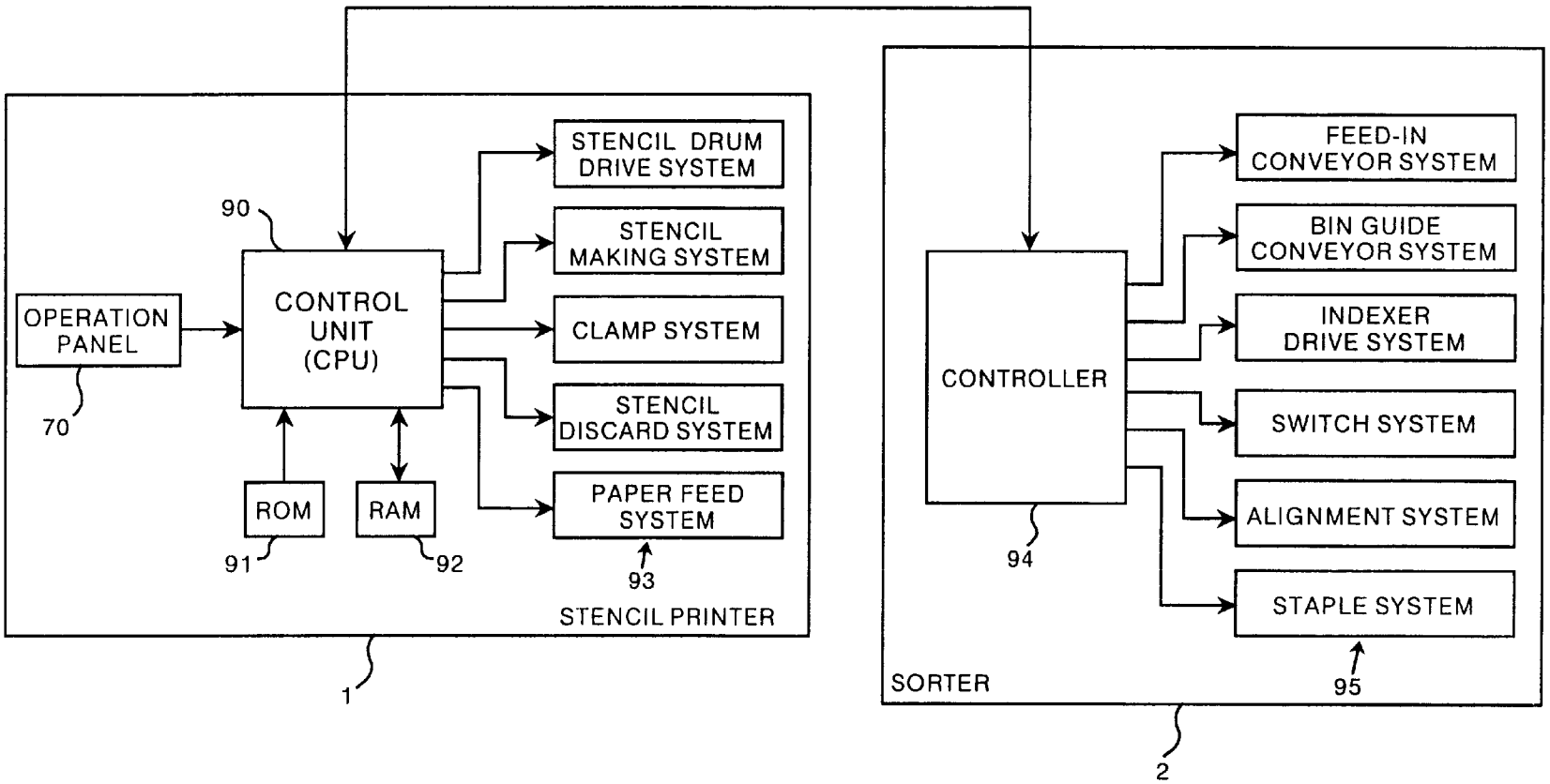
FIG. 7 is a block diagram of a control circuit.

FIG. 7 is a block diagram showing the configuration of the control circuit of the present embodiment. As shown in FIG. 7, the control circuit comprises a stencil printer system group 93 responsive to instructions from the operation panel 70 and including a stencil drum drive system, a stencil making system, a clamp system, a stencil discard system and a paper feed system, and further comprises a controller 94 for driving the sorter 2, a ROM 91 for storing a program and setting data, and a control unit (CPU) 90 for controlling the controller 94 based on the program and setting data stored in the ROM 91. The controller 94 of the sorter 2 is responsive to commands from the control unit 90 for driving a system group 95 of the sorter 2 that includes a feed-in conveyor system, a bin guide conveyor system, an indexer drive system, a switch system, an alignment system and a staple system. A RAM 92 is provided in association with the control unit 90 for storing the number of copies to be printed, the sorter mode and other settings, whenever they are input through the operation panel 70.

Control Program

The operation of the present embodiment will now be explained with reference to flowcharts. To simplify the explanation, the present embodiment is defined as having a row of bins 21 consisting of 20 bins.

When the system is in the standby mode, the display 77 shown in FIG. 6 displays the operating state of the stencil printer 1, the selected sorter mode, the staple mode, the size of the paper loaded in th e sheet feeder tray 473, and a numeral representing the connected sorter. The sorter mode and the staple mode displayed in reverse video are the ones currently in effect.

Setting Operating Mode When in Standby State

Figure 8:
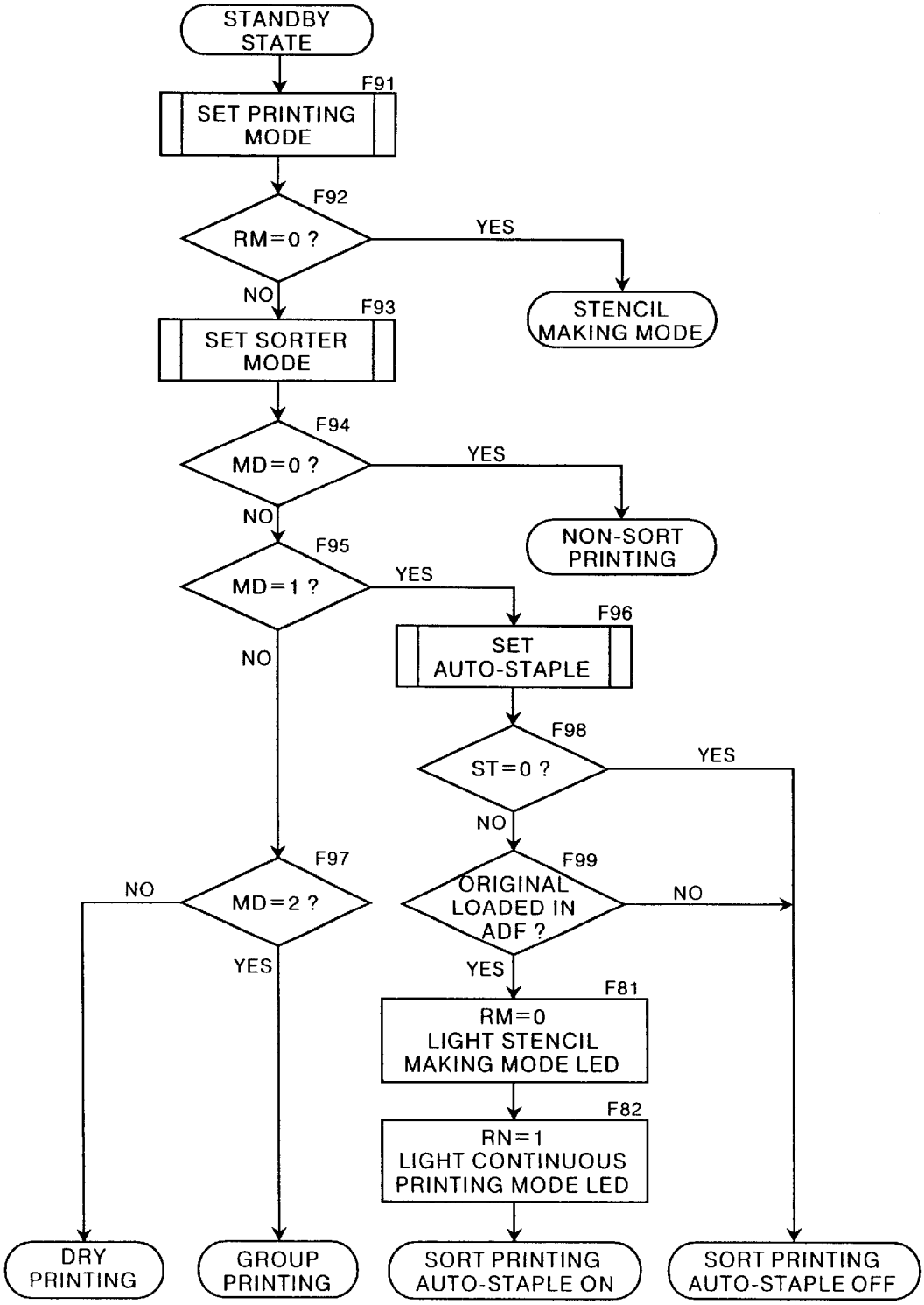
FIG. 8 is a flowchart showing the flow of processing for setting operating mode when in the standby state.

FIG. 8 is a flowchart showing the flow of processing for setting operating mode when the sorter 2 is in standby state. First, in step F91, the operator uses the stencil/print button 76 of the operation panel 70 to set the printing mode. In step F91, when a stencil has not yet been made or a once-made stencil is to be remade and the stencil making mode is selected, "0" is written to a register RM, and when stencil making has been completed and the printing mode is selected, "1" is written to register RM. Next, in step F92, it is checked whether RM=0. When the result is YES, stencil making is conducted. When the result is NO (when R=1), control passes to step F93, in which the operator uses the sorter mode button 60 to select the sorter mode and the selected sorter mode number is written to a register MD. MD=0 designates non-sort mode, MD=1 designates sort mode, MD=2 designates group mode, and MD=3 designates dry mode.

Next, in step F94, it is checked whether MD=0. When the result is YES, non-sort printing is conducted, and when it is NO, control passes to step F95, in which it is checked whether MD=1. When MD=1, the staple button 61 is enabled so that auto-stapling can be set in step F96. Owing to this arrangement, even if the operator should by mistake attempt to set the auto-stapling mode with respect to printed sheets P inserted in the bins in a mode other than sort mode, the mistake will not result in undesired stapling of the printed sheets P after completion of the printing operation.

Figure 11:
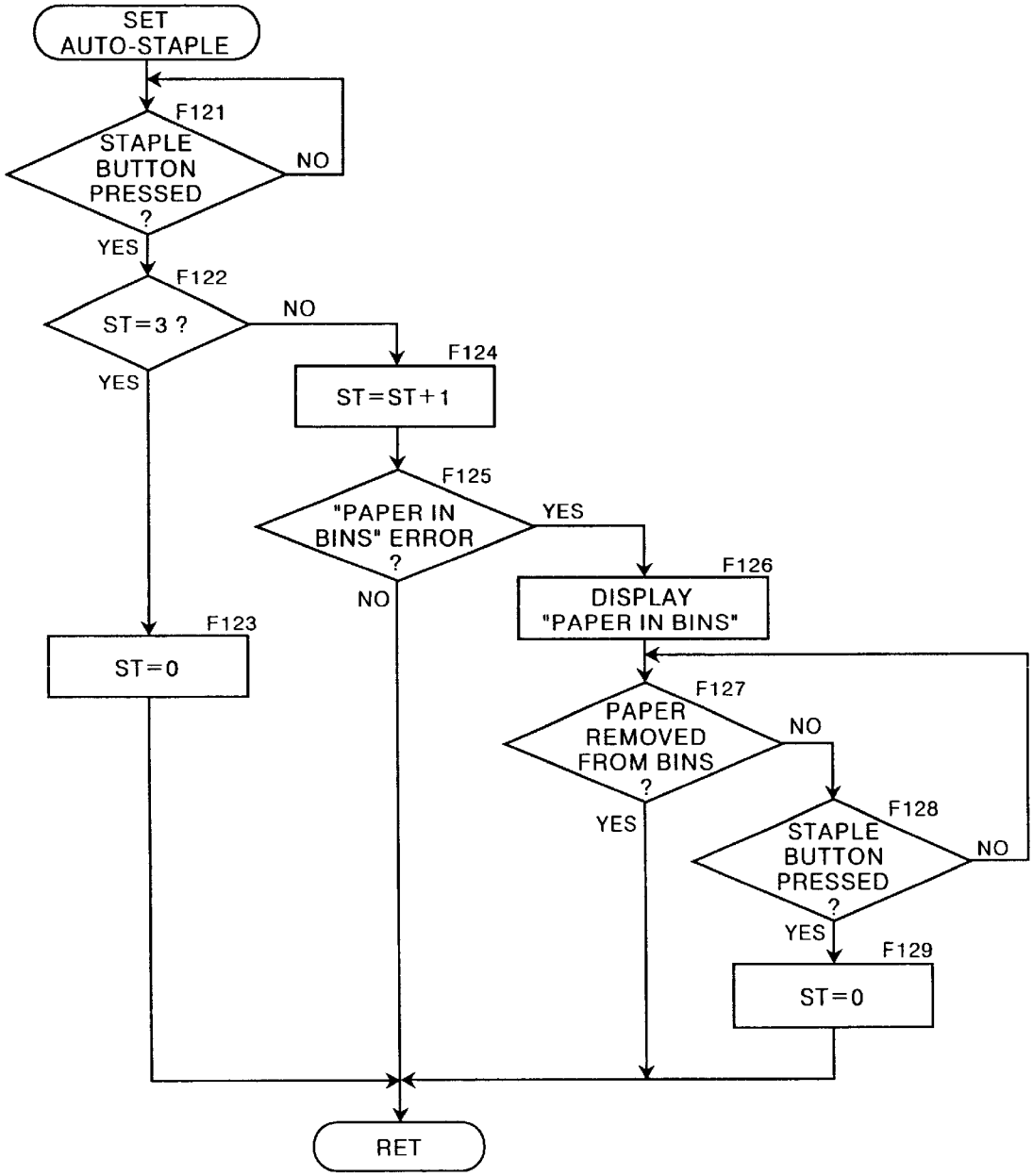
FIG. 11 is a flowchart showing the flow of processing for setting auto-stapling.

The operator activates the subroutine for setting auto-stapling of step F96 by pressing the staple button 61 and the number of the selected mode is simultaneously stored in a register ST (see FIG. 11). ST=0 designates stapling OFF, ST=1 designates single stapling on the near side, ST=2 designates double stapling at the center, and ST=3 designates single stapling on the far side. When an original is loaded in the ADF 413 then, provided that ST is a value other than "0" (F98, F99), stencil making mode is implemented, "0" is written to register RM, the stencil making mode LED 78 is lit and the continuous printing mode is turned ON in step F81, whereafter "1" is written to a register RN and the continuous printing LED 65 is turned on in step F82. By continuous printing mode is meant a mode in which a stencil is made from one original, the stencil is used to print the set number of copies, and the same process is repeated until no more originals are present in the ADF. When ST=0, or when no original is present in the ADF 413, auto-stapling is turned OFF and sorting is conducted but stapling is not. The reason for this is that the time of completion of printing of the final original cannot be ascertained when printed is conducted without using the ADF 413.

When the result in step F95 is NO, it is checked in step F97 whether MD=2. When the result is YES, group printing is conducted. When it is NO, dry printing is conducted.

Setting Printing Mode

Figure 9:
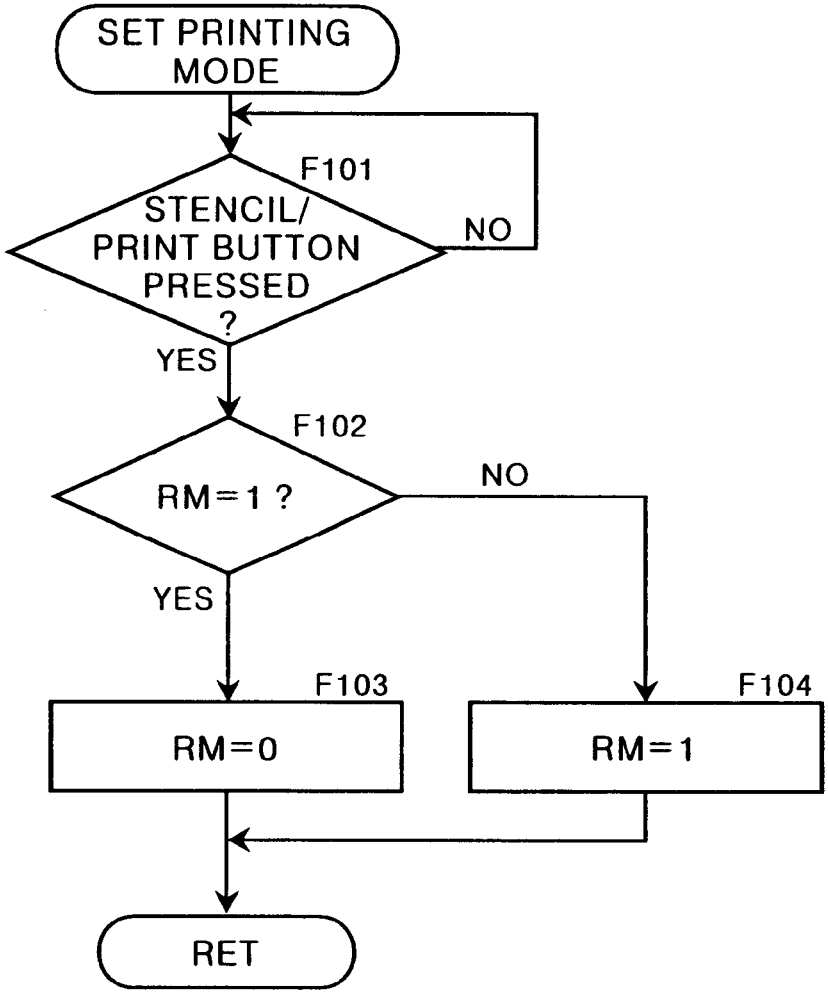
FIG. 9 is a flowchart for showing the flow of processing for setting printing mode.

FIG. 9 is a flowchart showing a subroutine for selecting printing mode executed in step F91 of FIG. 8. First, when it is found in step F101 that the stencil/print button 76 was pressed, control passes to step F102, in which it is checked whether register RM=1. When register RM=1, RM is made 0 in step F103 to switch from printing mode to stencil making mode. When RM=0, RM is made "1" in step F104 to switch from stencil making mode to printing mode.

Setting Sorter Mode

Figure 10:
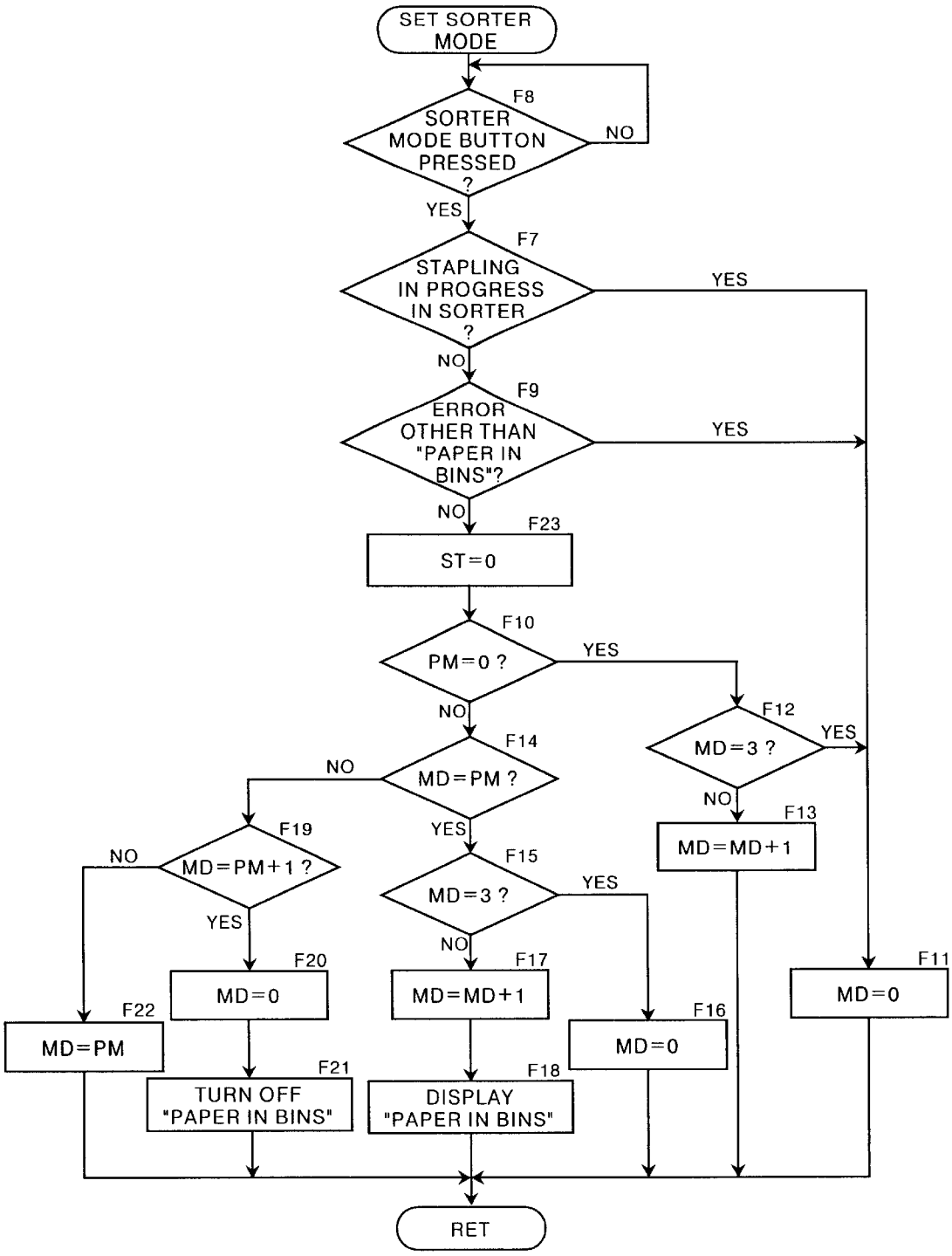
FIG. 10 is a flowchart showing the flow of processing for setting sorter mode.

FIG. 10 is a flowchart showing the flow of processing for setting the sorter mode when the system is idle. The sorter mode in which the sorter is set is stored in a register MD. As indicated earlier, MD=0 designates non-sort mode, MD=1 designates sort mode, MD=2 designates group mode, and MD=3 designates dry mode. The default value of register MD set at power-on is zero.

First, when it is found in step F8 that the sorter mode button 60 was pressed, it is checked in step F7 whether stapling is in progress in the sorter 2. When stapling is in progress, printed sheets P cannot be inserted in the sorter 2, so in such case control is passed to step F11, in which register MD is rewritten to MD=0 (non-sort mode). Even if stapling is not in progress, when it is found in step F9 that an error other than "Paper in bins" error has occurred on the sorter 2 side, register MD is rewritten to MD=0 (non-sort mode) in step F11, because the sorter is unusable and a mode using the sorter cannot be implemented. Thus when the sorter has experienced an error other than "Paper in bins," the non-sort mode is automatically selected notwithstanding that an operating mode that uses the sorter 2 was selected. This eliminates the need to reset the sorter mode.

When an error other than "Paper in bins" has not arisen in the sorter 2, control passes to step F23, in which the staple mode is turned OFF and "0" is stored in register ST. The reason for this is that if the staple mode should be left on despite the sorter mode having been switched, stapling might occur as a misoperation.

The sorter mode in effect when the printed sheets were discharged from the stencil printer 1 is stored in a register PM. PM=0 designates no paper, PM=1 designates sort mode, PM=2 designates group mode, and PM=3 designates dry mode. The default value of register PM set at power-on is zero. PM is also set to "0" if no paper is present in the sorter when sort mode is in effect, when printing is effected in non-sort mode, and when printing in sort mode, group mode or dry mode is completed and the printed sheets are removed before the subsequent sorter mode is set. Next, in step F10, when it is found that PM=0, i.e., that no printed sheets P remain in the sorter 2, control passes to step F12, in which it is checked whether the value of register MD before the sorter mode button 60 was pressed was 3. When the result is NO, the value of register MD is incremented by 1 in F13 to advance the mode by one. When the result in F12 is YES, meaning that the value of register MD before the sorter mode button 60 was pressed was 3, register MD is rewritten to "0" in step F11.

When the result in step F10 is NO, meaning that printed sheets P are present in the bins, control passes to step F14, in which it is checked whether the sorter mode MD currently in effect and the mode PM in effect when the printed sheets were discharged from the stencil printer 1 are the same. When the result is YES (MD=PM), control passes to step F15, in which it is checked whether MD=3 (dry mode). When the result is YES, control passes to step F16, in which a switch from dry mode to non-sort mode (MD=0) is effected. When the result in step F15 is NO, the value of register MD is incremented by 1 in step F17 to advance the mode by one and "Paper in bins" error is displayed in step F18.

When the register MD value and the register PM value are found to be different in step F14, control passes to step F19, in which it is checked whether the sorter mode before the sorter mode button 60 was pressed (register MD value) is equal to the mode when the printed sheets were discharged from the stencil printer 1 plus 1. A YES result in step F19 means a "Paper in bins" error has occurred. When the sorter mode button 60 is pressed under such circumstances, therefore, MD is set to "0" in step F20 to make the sorter mode non-sort mode, irrespective of the value of register MD, and the "Paper in bins" error is cleared in step F21. A NO result in step F19 means that the non-sort mode is set with paper present in the bins. In this case, control passes to step F22, in which the sorter mode is changed to the mode at the time the printed sheets P were sorted into the bins.

The control set out in the foregoing prohibits sorter mode change and maintains the non-sort mode when the sorter 2 is engaged in stapling. Therefore, even if the operator should by mistake attempt to select the sort mode when the sorter 2 is engaged in stapling, the mistake will not cause an undesired printing operation to occur. The control also prevents printed sheets sorted in a later selected mode from getting mixed in with printed sheets already present in the bins. At the time point when a "Paper in bins" error arises, moreover, the non-sort mode is set, skipping the other modes, because the occurrence of this error means that modes other than the non-sort mode and the mode in which the sheets in the bins were sorted cannot be used. This enables the sorter mode to be promptly switched without displaying the unusable modes.

Setting Auto-staple Mode

FIG. 11 is a flowchart showing a subroutine for auto-staple mode executed in step F96 of FIG. 8. The auto-staple mode is written in register ST. ST=0 designates stapling OFF, ST=1 designates single stapling on the near side, ST=2 designates double stapling at the center, and ST=3 designates single stapling on the far side.

First, when it is found in step F121 that the staple button 61 was pressed, it is checked in step F122 whether the value of register ST before the staple button 61 was pressed was 3. When the result is YES, ST is rewritten to "0" in step F123. When the result is NO, the value of register ST is incremented by 1 in step F124 to advance the mode by one. Next, in step F125, the output of the sheet sensor 40 (FIG. 4) is used to ascertain whether a "Paper in bins" error is present. When a "Paper in bins" error is present at the time point of a change from ST=0 to ST=1, "Paper in bins" error is displayed in step F126, a check is made in step F127 as to whether the printed sheets P have been removed from the bins, and when the result is YES, the "Paper in bins" error is cleared and the subroutine terminated.

Even if the printed sheets P have not been removed, when it is found in step F128 that the staple button 61 was pressed again, ST is rewritten to "0" in step F129 and the "Paper in bins" error is cleared. This is because the fact that auto-stapling operation is not permitted until the printed sheets P are removed from the bins makes it unnecessary to switch through all of the staple modes. This enables the operator to promptly clear the staple mode.

Operations During Auto-stapling

Figure 12:
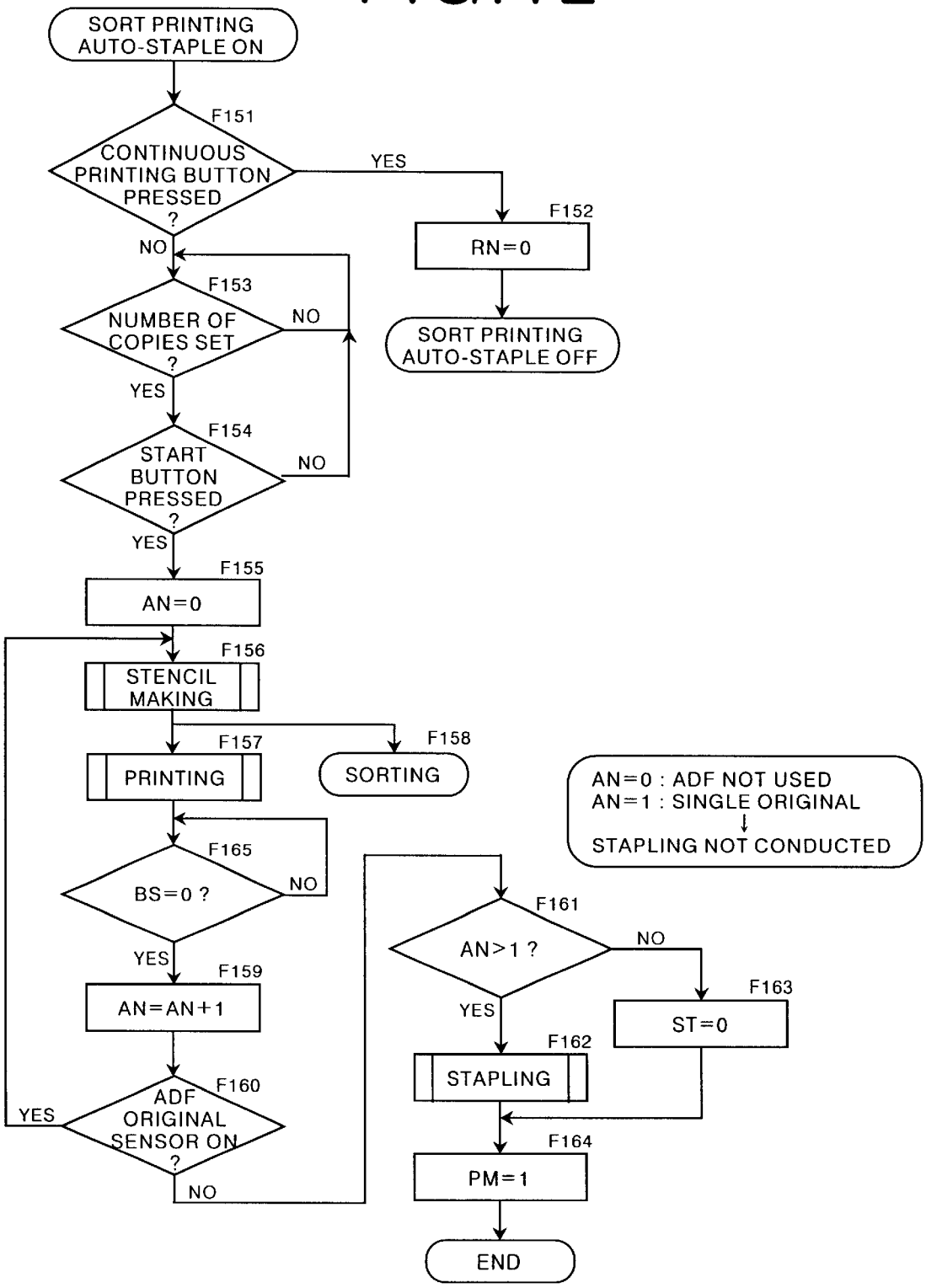
FIG. 12 is a flowchart of the operations during auto-stapling.

FIG. 12 is a flowchart of the operations during auto-stapling. First, before the start of the operations, it is checked in step F151 whether the continuous printing button 75 was pressed, and when the continuous printing button 75 was pressed, the value of register RN is set to "0" in step F152, the continuous printing mode is turned OFF, and stencil making is conducted.

When the continuous printing button 75 was not pressed, then upon finding in step F153 that the number of copies to be printed was set and finding in step F154 that the start button 71 was pressed, control passes to step F155, in which "0" is written to a register AN. Then number of originals for which stencils are made using the ADF 413 is written to register AN. Stencil making is then started in step F156. Completion of the making of each stencil is automatically followed by a printing operation of the stencil printer 1 under the control of the control unit 90 in step F157 and a simultaneous sorting operation of the sorter 2 under the control of the controller 94 in step F158. When the sorter 2 finishes sorting, the controller 94 writes "0" to a register BS.

Upon finding in step F165 that the value of register BS has become "0," the control unit 90 increments the value of register AN by 1 in step F159. Next, in step F160, a discrimination is made, based on whether or not the ADF original sensor 436 is ON, as to whether or not any originals remain in the ADF 413. When it is found that one or more originals remain in the ADF 413, control returns to step F156, whereafter stencil making and printing are repeated until no more originals remain in the ADF 413. When it is found in step F160 that no more originals remain, control passes to step F161, in which it is checked whether the value of register AN is greater than 1. When the result is YES, stapling is conducted in step F162, whereafter the number of the sorter mode when the printed sheets P were inserted in the bins is stored in register PM in step F164. Since they were inserted in sort mode, PM=1.

When it is found in step F161 that the value of register AN is "0," meaning that stencil making and printing were conducted without using the ADF 413, control passes to step F163, in which the value of register ST is set to "0" to prohibit stapling. When the value of register AN is "1," meaning that only a single original was fed in through the ADF 413, control passes to step F163, in which the value of register ST is set to "0" to prevent stapling because there is no need to staple a single printed sheet P.

Sort Operation

Figure 13:
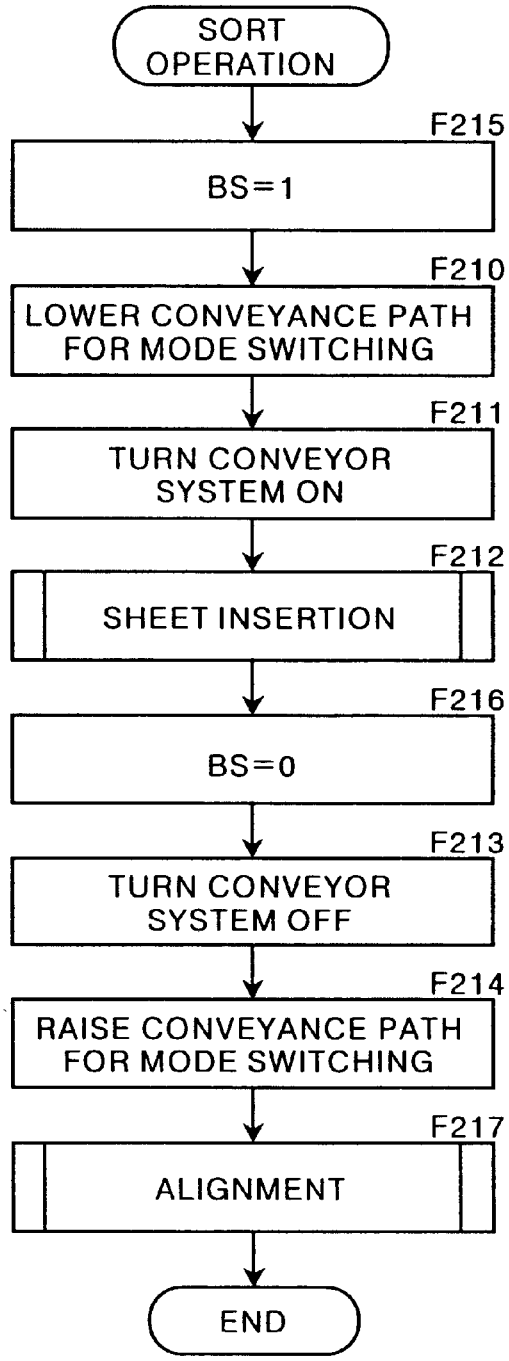
FIG. 13 is a flowchart showing sorter operation.

FIG. 13 is a flowchart showing the flow of sort operation processing in step F158 of FIG. 12. Upon the commencement of sort operation, the value of register BS is set to "1" is step F215. The value of register BS is set to "1" when the sorter 2 is in the process of receiving printed sheets P. As will be understood from the flowchart of FIG. 12, the control unit 90 controls the stencil printer 1 to start the next stencil making and printing operations only when the value of register BS is "0." The controller 94 therefore sets the value of register BS to "0" when the sorter 2 is conducting an operation unrelated to the stencil making and printing operations of the stencil printer 1, thereby achieving enhanced printing efficiency by enabling the stencil printer 1 and the sorter 2 to conduct processing simultaneously.

Next, in step F210, a DC motor is operated to lower the conveyance path 31 for mode switching, thereby switching the conveyance path so as to convey the printed sheets P to the sorter 2. Next, in step F211, conveyance of the printed sheets P to the bins 21 of the sorter 2 is enabled by turning on the DC motors for operating the conveyor belts 24 and 25 and turning on the suction fans 28 and 29. With the system in this state, control passes to step F212, in which a sheet insertion operation subroutine (see FIG. 14) is executed to insert the printed sheets P into the bins. Then, when insertion of all printed sheets P has been completed, control passes to step F216, in which the value of register BS is set to "0," to step F213, in which the conveyor belts 24 and 25 and the suction fans 28 and 29 are turned off, to step F214, in which the conveyance path 31 for mode switching is raised, and to step F217, in which an alignment subroutine (see FIG. 15) is executed.

Insertion Operation

Figure 14:
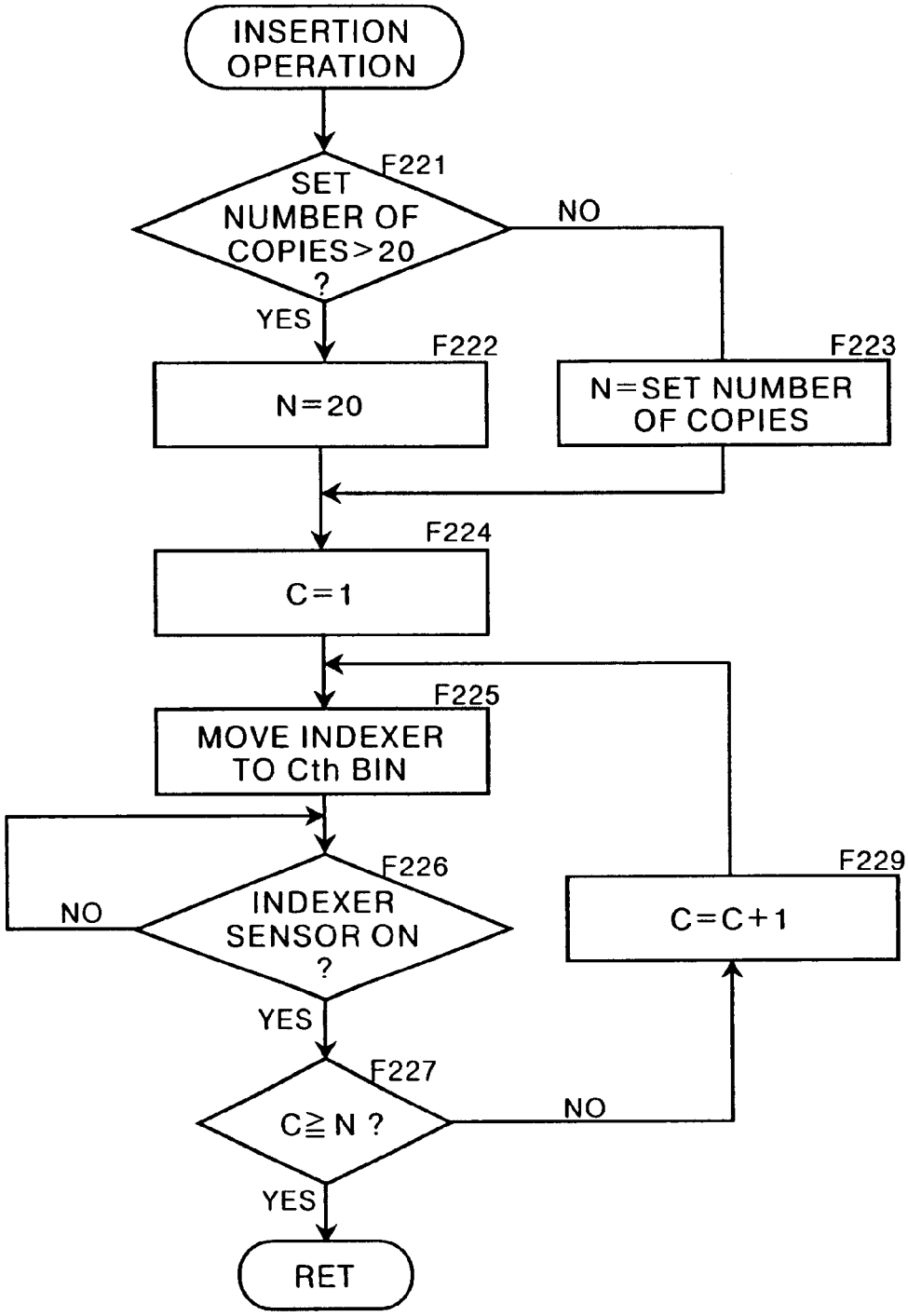
FIG. 14 is a flowchart showing receiving and holding operation.

FIG. 14 is a flowchart showing the flow of sheet insertion operations in step F212 of FIG. 13. First, in step F221, the set number of copies to be printed is compared with the number of bins (20). When the set number is equal to or less than the number of bins, the set value is written to register N in step F223. When the set number is greater than the number of bins, the number of bins (20) is written to register N in step F222. Next, in step F224, the value of a register C is set to 1. Then, in step F225, a DC servo motor is operated to move the indexer 22 to the Cth bin. Since C=1 at this time, the indexer 22 goes to the 1st bin. Then, when passage of a printed sheet P is ascertained in step F226 utilizing the indexer sensor 23, the value of register C is compared with the value of register N in step F227. When the value of register C is less than the value of register N, control passes to step F229, in which the value of register C is incremented by 1 and control is returned to step F225. When the value of register C becomes equal to the value of register N, the insertion operation is terminated.

Alignment Operation

Figure 15:
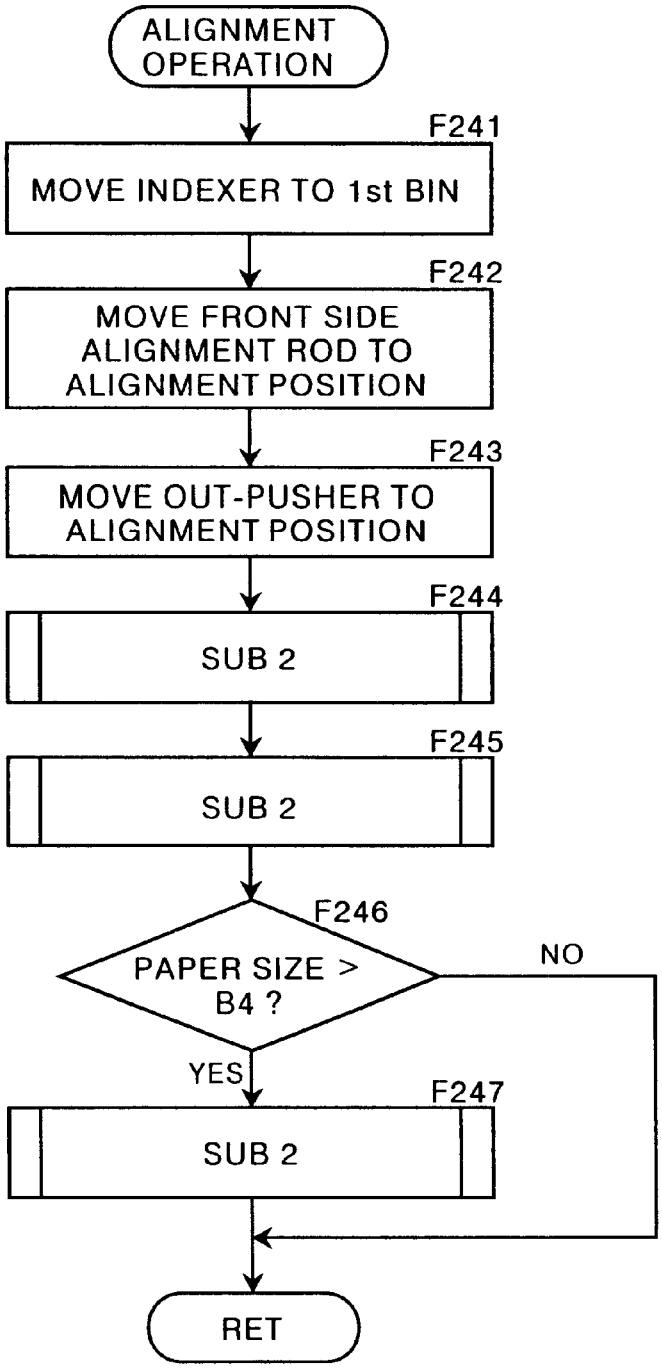
FIG. 15 is a flowchart showing alignment operation.
Figure 16:
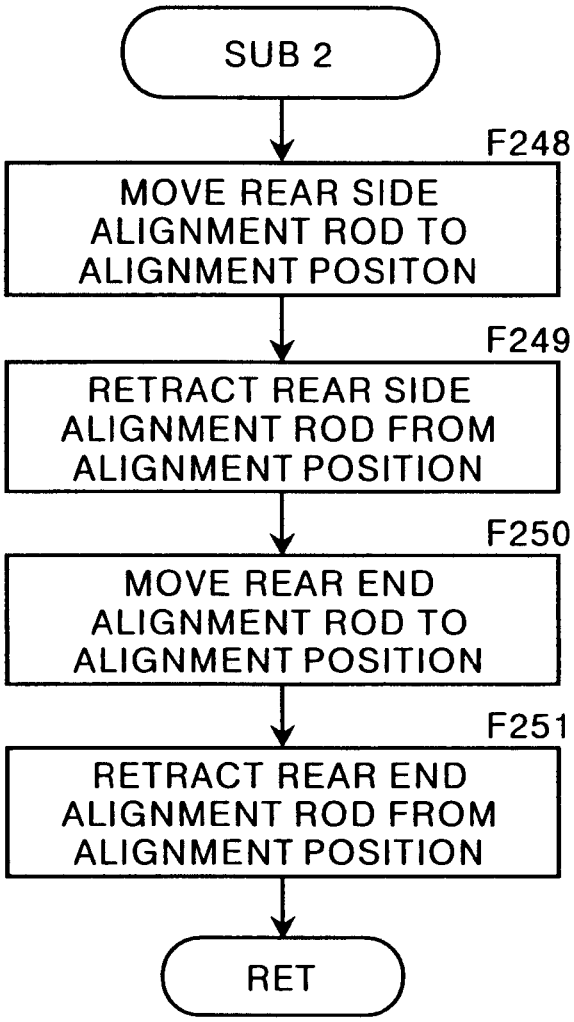
FIG. 16 is a flowchart of a subroutine 2 (SUB2) executed in the flowchart of FIG. 15.

FIG. 15 is a flowchart showing a subroutine for alignment operation executed in step F217 of FIG. 13. In the first step of the alignment operation, step F241, the indexer 22 is moved to the standby location (1st bin). Next, in step F242, the near side alignment rod 51 is moved to its alignment position for the size of the sheets to be aligned. After the near side alignment rod 51 has been moved to the alignment position, it is maintained stationary as an alignment reference for the far side alignment rod 52. Next in step F243, the out-pusher 53*a* of the rear end alignment rod 53 is moved to its alignment position. Subroutine 2 (SUB2) shown in FIG. 16 is then activated is to carry out alignment. This alignment is conducted twice irrespective of paper size, in steps F244 and F245, whereafter a check is made is step F246 as to whether the paper size is larger than B4. When the result in F246 is YES, a third alignment is conducted in step F247.

FIG. 16 is a flowchart showing the flow of processing in the subroutine 2 of FIG. 15. In the alignment in accordance with this subroutine, the far side alignment rod 52 is first moved to its alignment position in step F248, the far side alignment rod 52 is then retracted from its alignment position in step F249, and the rear end alignment rod 53 is thereafter moved to its alignment position in step F250. Next, in step F251, the rear end alignment rod 53 is retracted from its alignment position and alignment is effect by alternately pressing the far side alignment rod 52 and the near side alignment rod 53 against the printed sheets P.

Stapling Operation

Figure 17:
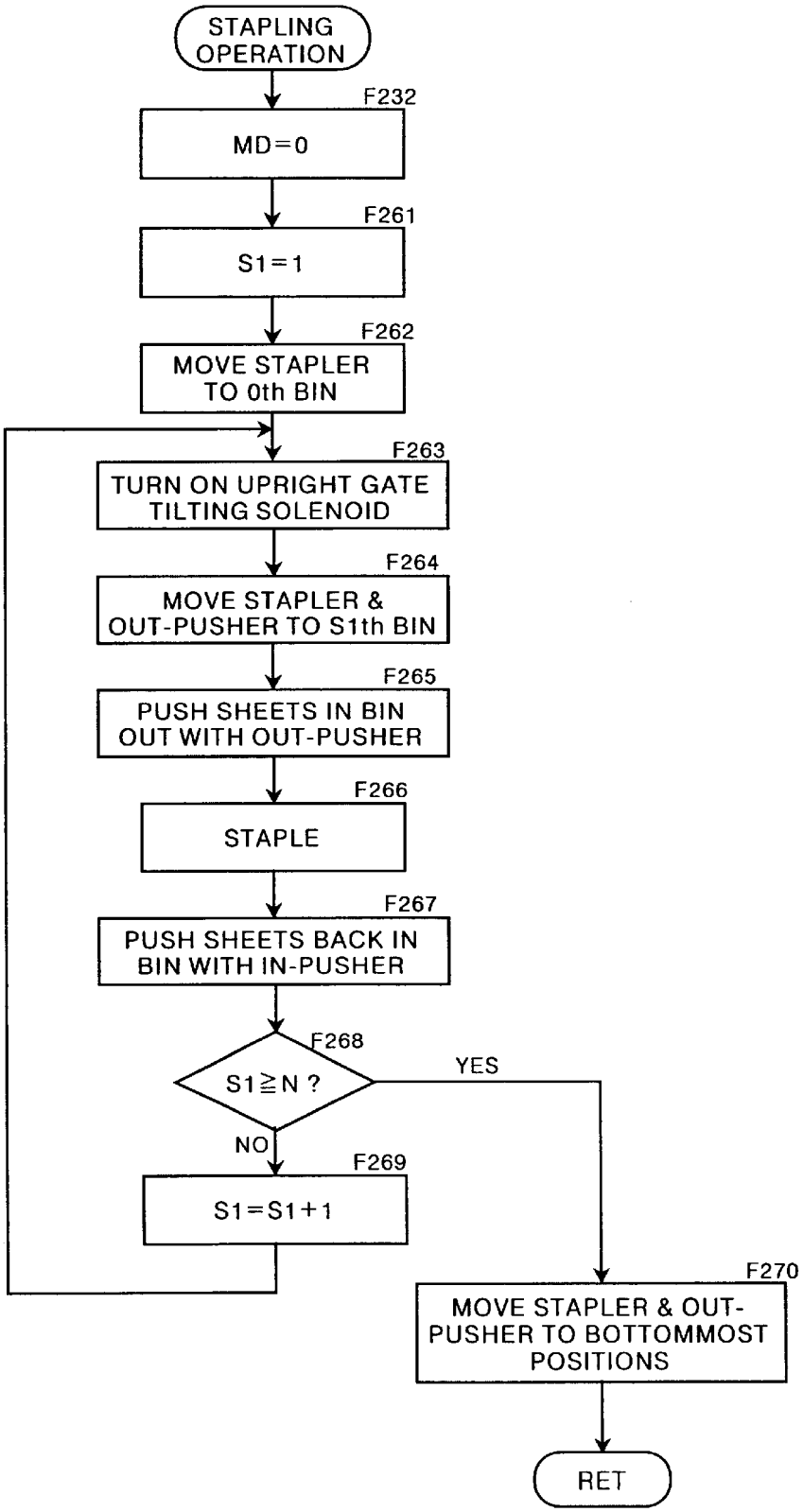
FIG. 17 is a flowchart showing stapling operation.

FIG. 17 is a flowchart showing the flow of processing in the stapling operation conducted in step F162 of FIG. 12. First, in step F232, "0" is stored in register MD to implement non-sort mode. Then, in step F261, the value of a register S1 is set to "1." The value of register S1 indicates the number of bins at which stapling was conducted. Next, in step F262, the stapler 34 is moved to the position of the 0th bin, the solenoid 37 for upright gate tilting (FIG. 5) is turned ON in step F263, and in this condition the stapler 34 is moved to the 1st bin in step F264. These operations press down the upright gate tilt lever 38 and open the upright gate 21*a*. The out-pusher 53*a* is also moved to the 1st bin and, in step F265, the out-pusher 53*a* of the rear end alignment rod 53 is operated to push the sheets in the 1st bin out toward the conveyor system side. Then, in step F266, the stapler 34 moves laterally to the stapling position and conducts stapling. The stapled printed sheets P projecting toward the conveyor system side are then pushed back into the bin by the in-pusher 36 in step F267. Next, in step F268, the value of register S1 and the value of register N are compared. When S1<N, control passes to step F269, in which the value of register S1 is incremented by 1 to effect stapling at the next bin and control is returned to step F263. When S1=N, meaning that the printed sheets P in all bins have been stapled, control passes to step F270, in which the stapler 34 and the out-pusher 53*a* are restored to their standby positions, and the stapling operation is terminated.

As explained in the foregoing, when the insertion operation step F212 in FIG. 13 is finished, the controller 94 of the sorter 2 sets the value of register BS to "0" and starts the alignment operation in step F217, while the control unit 90 of the stencil printer 1, upon finding that the value of register BS has become "0" in step F165 of FIG. 12, starts stencil making in step F156. The stencil printer 1 and the sorter 2 therefore conduct processing simultaneously during this period. The printing time of the overall system can therefore be markedly shortened.

In the embodiment described in the foregoing, the control unit 90 is thus responsive to completion of the insertion of the printed sheets in the finisher for substantially simultaneously starting the stencil making operation in the stencil printer 1 and the alignment operation in the sorter 2. Although this is the best arrangement, the starting time of the stencil making operation can instead be delayed somewhat from the starting time of the alignment operation. In other words, what is important in the present invention is that stencil making operation is started without waiting for completion of the alignment operation.

Although an embodiment whose sorter is equipped with a stapler was explained, the sorter need not necessarily have a stapler and can instead be equipped with only the alignment means. Such a printing system can achieve an effect similar to that of the foregoing embodiment by starting the stencil making operation in the printer substantially simultaneously with the start of the alignment operation by the alignment means after sheet insertion has been completed in the sorter.

Moreover, the printer of the present invention is not limited to a stencil printer but can be any type of printer that conducts both printing and stencil making.

Although the sorter 2 of the foregoing embodiment is equipped with a row of stationary bins 21 and an indexer 22 for inserting the printed sheets P into the bins, the sorter 2 can instead be one equipped with a row of moving bins.

In the case of the stencil printer 1, proper attachment of the stencil M when it is wound onto the outer surface of the stencil drum 463 is ensured by bringing the press roller 471 in contact therewith. To prevent soiling of the press roller 471 at this time, a sheet of printing paper P' is interposed between the stencil drum 463 and the press roller 471. The operation of the stencil printer 1 is therefore unique in that at the time each stencil M is attached a single sheet of printing paper is discharged in the manner of a printing test before the first regularly printed sheet P is discharged.

In the case of a sorter equipped with a row of stationary bins, this first discharged sheet is inserted into a special bin by the indexer 22. In the case of a sorter equipped with a row of moving bins, in order to insert the single sheet discharged before discharge of the regularly printed sheets into a special bin, it is necessary to move the entire row of bins to a standby location after the insertion operation. In the case of a sorter equipped with a row of moving bins, therefore, it suffices to program the control unit 90 of the stencil printer 1 to start stencil making operation at the same time that the controller 94 of the sorter 2 sets the value of register BS to "0" and begins the operation of moving the row of bins to the standby location after the sheet insertion operation is completed.

What is claimed is:

1. A printing system comprising:

a printer for conducting stencil making and printing, a finisher for receiving and holding printed sheets discharged from the printer and effecting at least one prescribed processing operation on the received printed sheets, and control means for starting stencil making in the printer without waiting for completion of said at least one prescribed processing operation in the finisher.

2. A printing system according to claim 1, wherein the control means is responsive to completion of the insertion of the printed sheets in the finisher for substantially simultaneously starting the stencil making operation in the printer and the at least one prescribed processing operation in the finisher.

3. A printing system according to claim 1 or 2, wherein the finisher is a sorter comprising a row of stationary bins for holding the printed sheets, sheet sorting means for inserting the printed sheets into the bins and alignment means for aligning the printed sheets held in the bins, and the at least one prescribed processing operation is an alignment operation conducted by the alignment means.

4. A printing system according to claim 1 or 2, wherein the finisher is a sorter comprising a row of stationary bins for holding the printed sheets, sheet sorting means for inserting the printed sheets into the bins, alignment means for aligning the printed sheets held in the bins and stapling means for stapling sheaves of printed sheets held in the bins, and the at least one prescribed processing operation is an alignment operation conducted by the alignment means and a stapling operation conducted by the stapling means.

5. A printing system according to claim 1 or 2, wherein the finisher is a sorter comprising a row of moving bins for holding the printed sheets and the at least one prescribed processing operation is an operation of moving the row of bins to a standby location.

* * * * *